US005927840A

United States Patent [19]

Bzowski

[11] Patent Number: 5,927,840

[45] Date of Patent: Jul. 27, 1999

[54] CADDY SYSTEM USED WITH A LOUVERED VENT LOCKER DOOR

[76] Inventor: Edward D. Bzowski, 9 Winsor La., Johnston, R.I. 02919

[21] Appl. No.: 08/970,711

[22] Filed: Nov. 14, 1997

[51] Int. Cl.[6] ..... E06B 1/00

[52] U.S. Cl. ..... 312/321.5; 211/88.01; 211/103; 211/119.04; 248/244

[58] Field of Search ..... 211/88.01, 103, 211/94.01, 71.01, 119.04; 312/321.5; 248/243, 244, 245

[56] References Cited

U.S. PATENT DOCUMENTS

| | | | |
|---|---|---|---|
| 2,270,796 | 1/1942 | Hauser | 211/119.004 |
| 2,891,678 | 6/1959 | Levy | 211/88.01 |
| 2,982,423 | 5/1961 | Handler et al. | 211/88.01 X |
| 3,313,424 | 4/1967 | Gingher | 211/94.01 X |
| 4,051,789 | 10/1977 | Howitt | 248/243 X |
| 4,826,115 | 5/1989 | Novitski | 248/243 X |
| 4,828,120 | 5/1989 | Beil et al. | 211/88.01 |

*Primary Examiner*—Peter M. Cuomo
*Assistant Examiner*—Stephen Vu
*Attorney, Agent, or Firm*—Salter & Michaelson

[57] ABSTRACT

A caddy system for lockers of the type having a set of louvered vents formed in the door of the locker for ventilation of the interior cavity of the locker, providing extra storage space within the interior cavity of the locker. The caddy system includes a pair of support rails each having a plurality of correspondingly associated rail slots formed therein, and at least one caddy container having a pair of tabs extending from the rear side thereof which fit within any corresponding pair of selected rail slots in the support rails. A fastening assembly attaches the support rails to the louvered vents in the locker door in a predetermined parallel spaced relation at the interior of the locker door.

6 Claims, 3 Drawing Sheets

CADDY SYSTEM USED WITH A LOUVERED VENT LOCKER DOOR

BACKGROUND AND SUMMARY OF INVENTION

This invention relates generally to lockers, and more particularly to a caddy system used in combination with a locker having a set of louvered vents formed in the door of the locker. The caddy system is adjustably attached to the louvered vents at the interior of the locker door and provides extra storage space at the interior cavity of the locker, for any number of items that may be stored within the cavity of the locker.

The typical metal lockers of varying sizes usually have only one shelf for storing small articles. The half-size lockers typically have no shelves. This severely limits the amount of paraphernalia or personal items that can be conveniently stored within the locker. Only hooks are provided on the interior walls for hanging a variety of garments. This arrangement severely limits the neat and orderly storage of various items. In sports and recreation, a variety of personal grooming, hygiene and sports related materials can be stored in a caddy system. In schools, a variety of writing instruments, note pads and personal grooming materials, to mention a few, can also be stored in the caddy system. In the medical and industrial fields, it provides for neat and readily available storage for a variety of small items, such sample items as medicines, vials, small tools, gauges, etc.

The utility caddy of the instant invention requires no tools for assembly and installation. Only finger-tightening the thumb screws locks the assembly into place. The containers have tabs which slide into any of the regularly spaced slots on the rails and they too lock into position when lowered. Disassembly is equally simple by a reversal of the installation process. There is no alteration needed or damage done to the locker door.

The primary objective of the instant invention is to provide additional storage space for lockers of the type having vented louvers, with an easily installed caddy system which does not alter or deface the locker doors. The containers, or small baskets, are designed to hold a variety of personal grooming and hygiene articles in the sports/recreational area and miscellaneous items in school, medical, and industrial lockers. Inherent in this design, is the ease with which this caddy can be installed and removed. T-nuts are placed across the vents with the threaded portion facing inwardly, and the flange part resting on a projecting vent. A thumb screw, inserted through a hole in the rails, is tightened against the T-nut. Finger strength is sufficient to lock or pinch this assembly to the locker door. Baskets, with projecting tabs to fit the rail slots, are then lowered into position. Any slot position may be used to suit the user's needs. The lateral distance between rods must equal the tab positioning spacing of the containers, so that the containers will fit into the rail slots. Each container has two pairs of projecting tabs. The tabs lateral spacing is determined by the size of the locker door. Once the basket is lowered into position, any position of choice, it is secured in place by finger tightening the thumb screws. The parallel positioning of the rails allows the containers to be relocated without adjusting the rails. This is the only assembly adjustment necessary. To disassemble, simply reverse the procedure; lift and remove the baskets, unscrew the thumb screws on the rails, then remove the rails and the T-nuts. The caddy design of the instant invention is applicable to a variety of vented door locker sizes. No tools are required, and there is no damage or alteration to the locker. The length of the slotted rails will vary according to locker door length and to user's needs. The containers will also vary in size according to locker door sizes. The taller the locker, the longer the rails, and the greater the number of containers that can be fitted. The containers can also be customized for a particular need, such as, height, depth, compartments and construction material. The caddy assembly, when secured to the locker door, cannot be dislodged from the outside by any prankster or vandal. The frictional force of the thumb screw squeezing the support rail and T-nut between the locker louvered vent projection holds the assembly in place. Also, the T-nut flange impinges against the upper curved portion of the vent and prevents any upward thrust from the outside. Only a very small portion of the T-nut flange is visible from the outside; it is virtually undetectable.

Accordingly, among the several objects of the instant invention are: the provision of a locker and caddy system which provides extra storage space at the interior cavity of the locker; the provision of a locker and caddy system that is effective with lockers having louvered vents formed in the door of the locker; the provision of a locker and caddy system that may be quickly and easily installed or removed from the door of the locker without damaging the locker structure; the provision of a locker and caddy system that can only be adjusted or removed from the interior of the locker; the provision of a locker and caddy system that requires no tools for assembly and installation; the provision of a locker and caddy system that is neat and attractive in appearance; and the provision of a locker and caddy system that is cost efficient and easy to manufacture.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
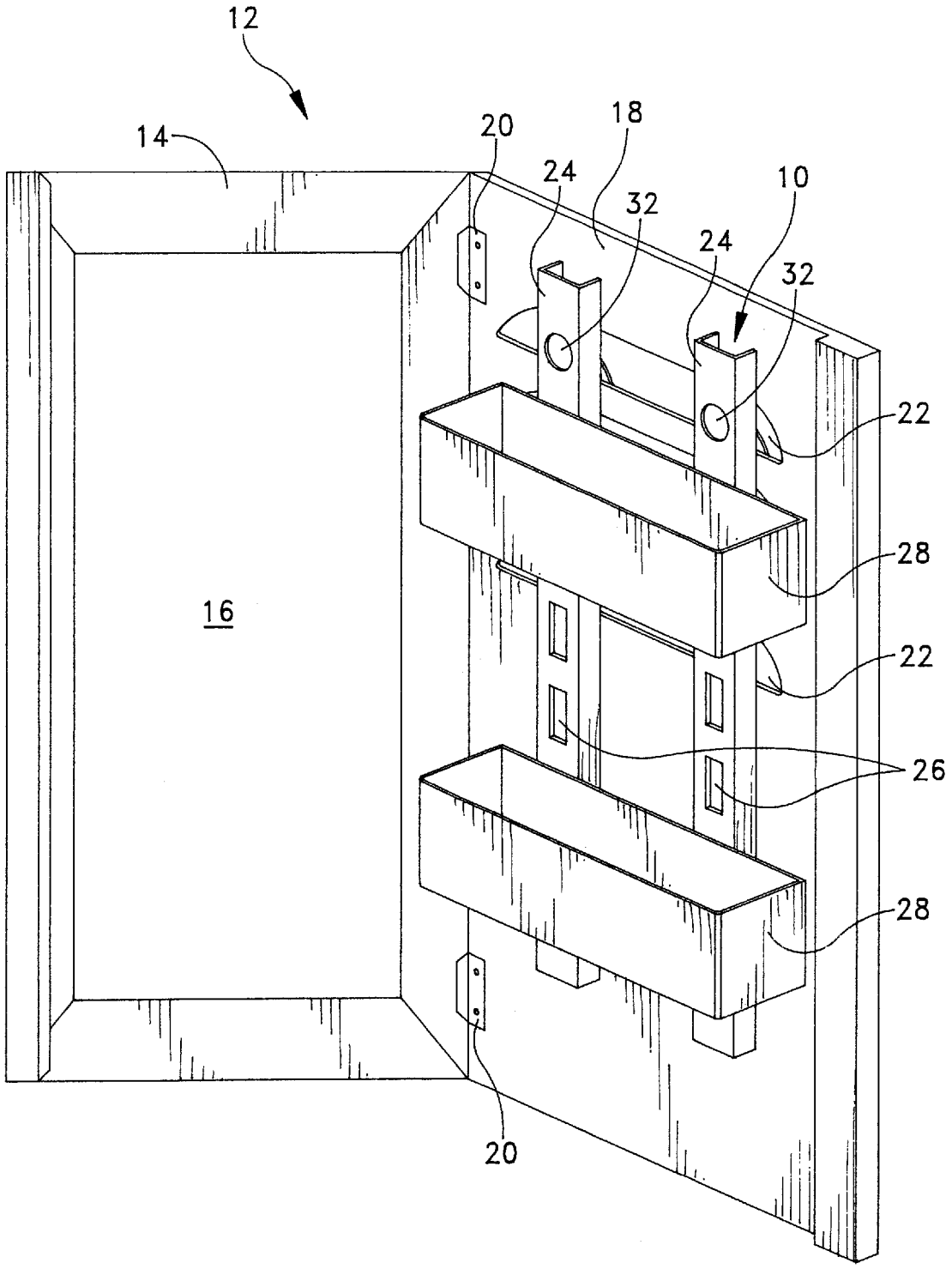
FIG. 1 is a perspective view of the utility caddy of the instant invention fitted to a locker door.
Figure 2:
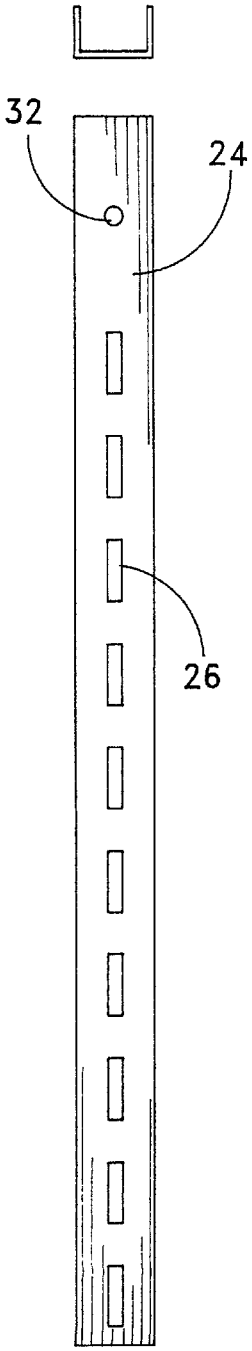
FIG. 2 is a front elevational view of a support rail of the caddy system of the instant invention.
Figure 3:
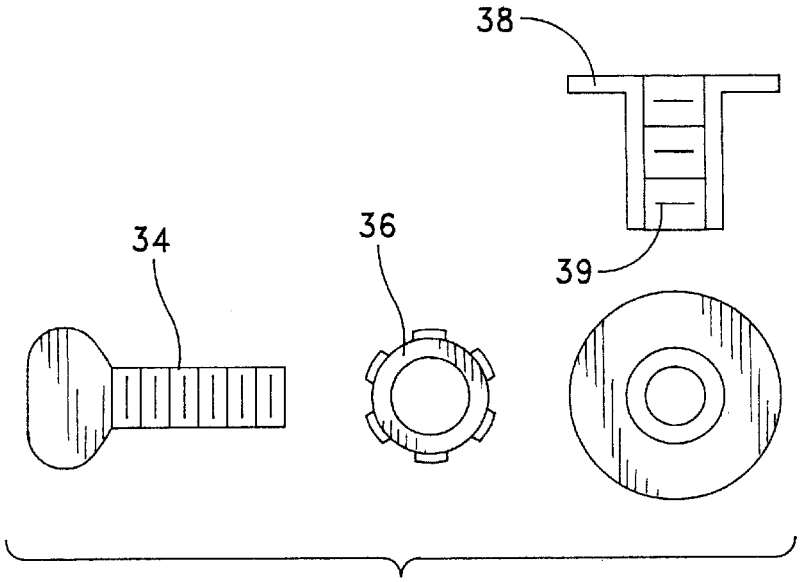
FIG. 3 is an exploded view of the locking mechanism of the instant invention.

Referring now to the drawings, and more particularly to FIG. 1, the utilitarian caddy of the instant invention is shown and generally indicated at 10. As will hereinafter be more fully described, the instant invention is effective for providing extra storage containers at the interior of a locker having a set of louvered vents extending across the door of the locker. The caddy system is particularly effective with lockers used in the athletic, recreational, and medical fields, whereby the containers provide for a neat and readily available storage space for a variety of small utility items. As shown in FIG. 1, the caddy system 10 of the instant invention comprises a conventional locker, generally indicated at 12, having a frame 14, an interior locker cavity 16, and a locker door 18. The locker door 18 is attached by hinges 20 to the frame 14 of the locker 12. The locker door 18 further includes a plurality of equally spaced horizontally disposed projecting louvered vents 22 which extend across the surface of the door 18. The vents 22 provide breathing openings for the interior cavity 16 of the locker 12. A pair of elongate support rails 24, having a plurality of rail slots 26, formed therein, are releasably attached to the louvre vents 22 at the interior of the locker door 18. A pair of caddy's or containers 28 each have a pair of tabs 30 extending from the rear side thereof, which are received in correspondingly associated rail slots 26 formed in the support rails 24 for releasably maintaining the caddy's 28 at the interior of the locker door 18. The caddy system 10 is effective for providing extra storage space within the interior of the locker cavity 16.

Figure 4:
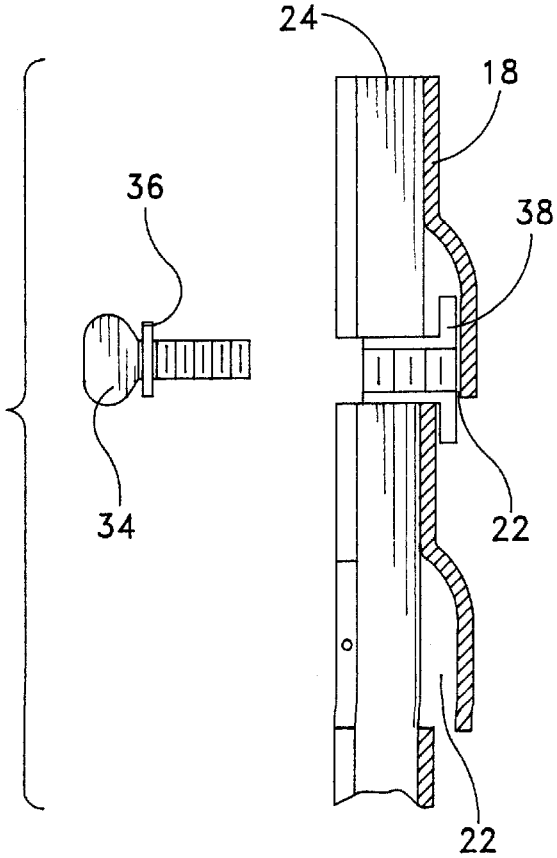
FIG. 4 is a sectional view of the utility caddy assembly locking procedure.
Figure 5B:
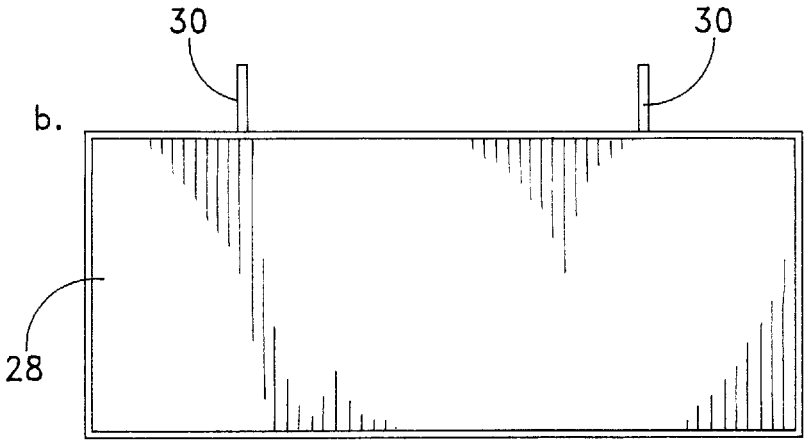
FIG. 5*b* is a top view of the basket of the instant invention.
Figure 5A:
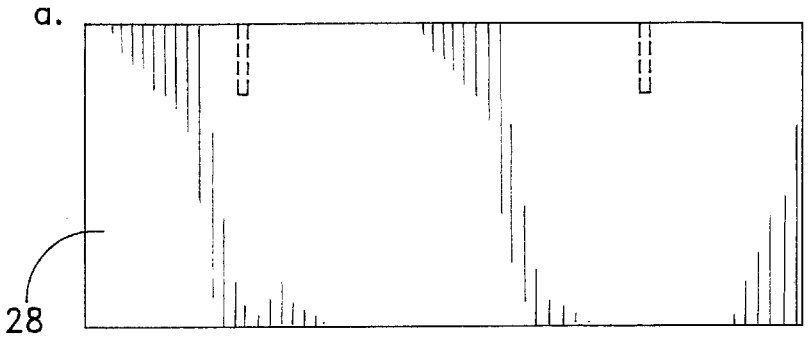
FIG. 5*a* is a front view of the basket of the instant invention.
Figure 6:
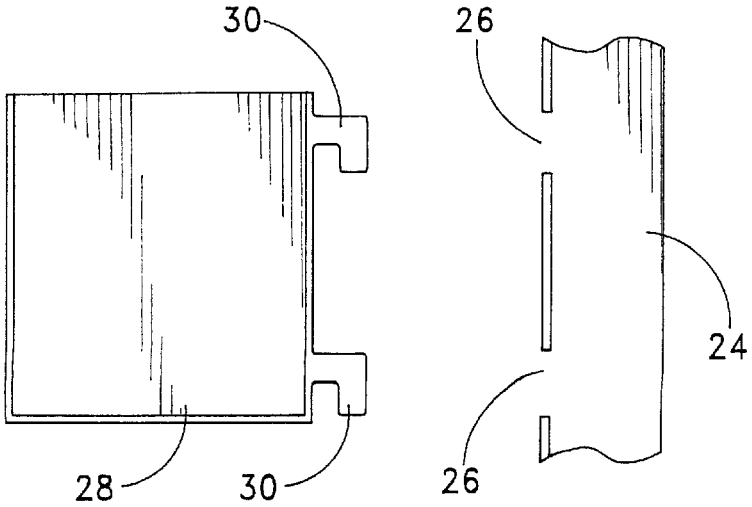
FIG. 6 is a side view illustrating the assembly procedure for fitting the basket to the rails.

Referring now to FIGS. 2–6, the manner in which the caddy system 10 is fastened to the interior of the locker door 18 is more clearly depicted. It should be noted that the caddy system 10 may be manually assembled without the need of any tools. A hole 32 is formed in each support rail 24 for accepting a fastener for securing each support rail 24 to the interior of the locker door 18. The fasteners include a thumb screw 34, a lock washer 36, and a T-nut 38. The arrangement is such that the support rails 24 are positioned at the interior of the locker door 18 in perpendicular relation to the louvered vents 22. The holes 32 located in each support rail 24 are positioned to correspond to the top louvered vent 22 at the interior of the locker door 18. Specifically, the T-nut 38 is positioned through the louvered vent 22, and the support rail 24 is positioned against the locker door 18; located so that the holes 32 are aligned with the threaded portion 39 of the T-nut 38. The lock washer 36 is fitted onto the thumb screw 34 as shown in FIG. 4. This assembly is passed through the support rail hole 32, and onto the T-nut 38. The thumb screw assembly 34 is loosely secured at this point. This procedure is repeated for the second support rail 24. Once both support rails 24 are loosely positioned, the container 28 is positioned into the rail slots 26. The support rails 24 are re-adjusted to accommodate the container 28 lateral tab 30 positions. The container tabs 30 drop into the rail slots 26 and lock into position. Several containers 28, FIGS. 5–6, can be fitted onto the support rails 24. The thumb screw assemblies 34, one for each rail, can now be finger tightened to secure the utility caddy 28, FIG. 1, to the locker door. To remove the utility locker caddy 28, remove the container(s), FIG. 5, and lift the container FIG. 6, so that the tabs 30 clear the rail slot opening 26 and are removed therefrom. Next, loosen and remove the thumb screw assembly 34. The support rails 24 become free and can be removed. Remove the T-nuts 38 from the door vents 22 and disassembly is completed.

It can therefore be seen that the instant invention provides for an effective caddy system that may be releasably adjusted to a locker door having louvered vents formed therein. The caddy system provides extra space at the interior cavity of the locker for a neater and more organized locker. The caddy system may be easily installed without the need of any tools. For these and other reasons described herein, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept, and that the same is not limited to the particular forms herein shown and described, except insofar as indicated by the scope of the appended claims.

What is claimed is:

1. A caddy system adapted to be mounted to a locker having a set of projecting louvered vents formed on a door of the locker for ventilation of an interior cavity of the locker, said caddy system comprising:

a pair of support rails having a plurality of spaced rail slots formed therein adapted to engage with the projecting louvered vents at an interior side of the locker door;

at least one container having a pair of tabs extending from a rear side thereof which fit within any corresponding pair of said rail slots in the support rail; and fastening means for adjustably attaching the support rail to the projecting louvered vents on the interior side of the locker door, said fastening means comprising a thumb screw and a T-nut, said T-nut having a threaded shaft adapted to extend through said louvered vent, wherein said threaded shaft faces inwardly so as to only be accessible from the interior of the locker, said T-nut further having a flange head, said flange head adapted to engage an interior surface of said projecting louvered vent and impinged thereagainst by tightening of said thumb screw for securing the support rails against the interior side of the locker door, and wherein said support rails have an opening through which said threaded shaft and said thumb screw extend.

2. A caddy system as set forth in claim 1, wherein said pair of support rails are parallel to each other and are attached to the projecting louvered vents at the interior side of the locker door.

3. A caddy system as set forth in claim 2, wherein a first lateral distance defined between said support rails equals to a second lateral distance defined between a pair of tabs positioned on said containers.

4. A caddy system as set forth in claim 3, wherein said container may be adjustably positioned along said support rails at any corresponding pair of said rail slots.

5. A caddy system as set forth in claim 1, wherein said T-nut flange is adapted to engage an upper angled portion of said louvered vent to prevent upward thrust from the exterior of the locker.

6. A caddy system in combination with a locker having a set of projecting louvered vents formed on a door of the locker for ventilation of an interior cavity of the locker, wherein said caddy system provides additional storage space within the interior cavity of the locker, said combination comprising:

said louvered vents including an angled portion extending downwardly from an outer surface of the door to a plane of the door;

a pair of support rails having a plurality of spaced rail slots formed therein;

at least one container having a pair of tabs extending from a rear side thereof which fit within any corresponding pair of said rail slots in the support rail; and fastening means for adjustably attaching the support rail to the projecting louvered vents on an interior side of the locker door, said fastening means comprising a thumb screw and a T-nut, said T-nut having a threaded shaft adapted to extend through said louvered vent wherein said threaded shaft faces inwardly so as to only be accessible from the interior of the locker, said T-nut further having a flange head, said flange head adapted to engage an interior surface of said projecting louvered vent and impinged thereagainst by tightening of said thumb screw for securing the support rails against the interior side of the locker door, and wherein said support rails have an opening through which said threaded shaft and said thumb screw extend.

* * * * *